US008950607B2

(12) United States Patent
Rieppel

(10) Patent No.: US 8,950,607 B2
(45) Date of Patent: Feb. 10, 2015

(54) FEEDING ASSEMBLY FOR A BABY FEEDING BOTTLE WITH ENHANCED FLOW CHARACTERISTICS

(75) Inventor: Michele Rieppel, Mansfield, PA (US)

(73) Assignee: Michele Rieppel, Mansfield, PA (US)

( * ) Notice: Subject to any disclaimer, the term of this patent is extended or adjusted under 35 U.S.C. 154(b) by 333 days.

(21) Appl. No.: 13/479,472

(22) Filed: May 24, 2012

(65) Prior Publication Data

US 2012/0298611 A1 Nov. 29, 2012

Related U.S. Application Data

(60) Provisional application No. 61/490,257, filed on May 26, 2011.

(51) Int. Cl.

| | |
|---|---|
| ***A61J 9/00*** | (2006.01) |
| ***A61J 11/04*** | (2006.01) |
| ***A61J 11/00*** | (2006.01) |

(52) U.S. Cl.

CPC *A61J 9/00* (2013.01); *A61J 11/001* (2013.01); *A61J 11/04* (2013.01)

USPC ..... 215/11.4

(58) Field of Classification Search

CPC ..... A61J 11/002; A61J 11/04; A61J 11/001; A61J 11/00; A61J 9/00; A47G 19/2272; A47G 19/2266; A47G 19/2205

USPC ..... 215/11.4, 11.3, 11.6, 11.1, 313, 311, 215/310, 307, 228, 200; 220/212, 495.03, 220/495.06, 253, 714, 713, 711, 703, 220/203.05, 203.04, 203.02, 203.01, 220/203.19, 200; 222/547, 544, 570, 567, 222/532, 531, 526, 566, 545; 606/236; D9/563, 450, 449, 447, 435; D7/312, D7/300

See application file for complete search history.

(56) References Cited

U.S. PATENT DOCUMENTS

| | | | | |
|---|---|---|---|---|
| 2,174,361 | A | | 9/1939 | Condon |
| 2,196,870 | A | | 4/1940 | Little |
| 2,372,281 | A | * | 3/1945 | Jordan ..... 215/11.5 |
| 2,588,069 | A | | 3/1952 | Allen |
| 2,616,581 | A | | 11/1952 | Madsen et al. |
| 2,630,932 | A | | 3/1953 | Lestakis |
| 3,082,770 | A | | 3/1963 | Straub |
| 3,139,064 | A | | 6/1964 | Jean-Louis Harle |
| 4,765,497 | A | | 8/1988 | Hsu |

(Continued)

OTHER PUBLICATIONS

International Search Report and Written Opinion dated Oct. 4, 2012 for corresponding international application No. PCT/US2012/039281.

*Primary Examiner* — Robert J Hicks

(74) *Attorney, Agent, or Firm* — Renner, Otto, Boisselle & Sklar, LLP

(57) ABSTRACT

A feeding assembly for a baby feeding bottle includes a control nipple for receiving a fluid from a container, and an outlet nipple positioned to receive the fluid from the control nipple and having a feeding outlet through which the fluid flows from the feeding assembly. The control nipple and outlet nipple are moveable relative to each other from a first position to a second position, such that in the first position the fluid is transferred through a tip of the control nipple to the outlet nipple at a first flow rate, and in the second position the fluid is transferred through the tip of the control nipple to the outlet nipple at a second flow rate different from the first flow rate. A baby feeding bottle includes a container portion for containing a fluid, and the described the feeding assembly.

20 Claims, 7 Drawing Sheets

(56) References Cited

U.S. PATENT DOCUMENTS

| | | | | |
|---|---|---|---|---|
| 4,909,253 | A | 3/1990 | Cook et al. | |
| 5,108,686 | A | 4/1992 | Griffin | |
| 5,117,994 | A * | 6/1992 | Leblanc et al. | 215/11.1 |
| 5,150,800 | A | 9/1992 | Sarter et al. | |
| 5,211,300 | A | 5/1993 | Hsing et al. | |
| 5,653,732 | A | 8/1997 | Sheehy | |
| 5,881,893 | A | 3/1999 | Manganiello | |
| 6,161,710 | A | 12/2000 | Dieringer et al. | |
| 6,343,704 | B1 | 2/2002 | Prentiss | |
| 6,645,228 | B2 | 11/2003 | Renz | |
| 6,883,672 | B2 * | 4/2005 | Dunn et al. | 215/11.5 |
| 6,957,744 | B2 | 10/2005 | Holley, Jr. | |
| 6,966,904 | B2 | 11/2005 | Ruth et al. | |
| 7,036,975 | B2 | 5/2006 | Renz | |
| 7,320,678 | B2 | 1/2008 | Ruth et al. | |
| 7,326,234 | B2 | 2/2008 | Lieberman et al. | |
| 7,975,861 | B2 | 7/2011 | Rieppel | |
| 2002/0063103 | A1 | 5/2002 | Kiernan | |
| 2003/0192851 | A1 | 10/2003 | Ziegler | |
| 2004/0026351 | A1 * | 2/2004 | Dunn et al. | 215/11.1 |
| 2004/0245203 | A1 | 12/2004 | Goldman et al. | |
| 2005/0184022 | A1 | 8/2005 | Dunn et al. | |
| 2005/0199637 | A1 | 9/2005 | Wong | |
| 2005/0247658 | A1 | 11/2005 | Renz | |
| 2008/0210655 | A1 | 9/2008 | Rees et al. | |
| 2010/0025352 | A1 | 2/2010 | Rieppel | |
| 2011/0046671 | A1 | 2/2011 | Okoturo | |
| 2011/0065360 | A1 | 3/2011 | Francis | |

* cited by examiner

FEEDING ASSEMBLY FOR A BABY FEEDING BOTTLE WITH ENHANCED FLOW CHARACTERISTICS

RELATED APPLICATION DATA

The present application claims the benefit of U.S. Provisional Application Ser. No. 61/490,257, filed May 26, 2011, the disclosure of which is herein incorporated by reference in its entirety.

TECHNICAL FIELD OF THE INVENTION

The technology of the present disclosure relates generally to a feeding assembly for a baby feeding bottle, and more particularly to a feeding assembly for a baby feeding bottle having enhanced flow characteristics to adjust the flow of a feeding liquid to accommodate different feeding capacities.

DESCRIPTION OF THE RELATED ART

Baby feeding bottles are known in the art, and, despite the increase in breastfeeding, bottles still commonly are used for feeding. Indeed, baby feeding bottles may be necessary in certain circumstances. For example, premature babies in a neonatal intensive care unit (N.I.C.U.) sometimes are not born with a sufficient suck-swallow-breathe reflex needed for breastfeeding. In addition, N.I.C.U. babies that are breastfed may need supplemental bottle feedings in circumstances when the mother may not be capable of or available for every feeding.

Even outside the hospital setting, bottle feeding may be desirable at times. Newborns that are "lazy nursers" may need supplemental bottle feedings in addition to breastfeeding. In addition, intermittent or occasional bottle feedings may aid bonding between newborns and a father, and otherwise may permit a non-parent caretaker to feed an infant when a mother is not present or available for breastfeeding. Mothers also may wish to provide supplemental bottle feedings at times or locations when breastfeeding may be uncomfortable. Bottles used for supplemental feedings may have a nipple with a hole configuration to mimic a woman's breast. In this manner, feeding behavior disruptions caused by switching between breast and bottle feedings may be reduced.

For hospitals and other healthcare centers, daycare centers, and other locations that care for numerous infants at once, bottles may be washed and sterilized, and reused. Often, infants at different stages of development may have different feeding needs and capacities. For example, a premature infant may have a relatively low feeding need and capability as compared to an infant who is six months old. It is desirable, therefore, to provide a bottle with a liquid flow that is commensurate with an infant's developmental stage and feeding capacity. A premature infant with deficient feeding reflexes may be provided a bottle with a minimal flow rate, while a healthy newborn may be provided with a bottle having an intermediate flow rate, and an older infant may be provided with a bottle having an advanced flow rate. Even as to a single infant, parents may recognize a similar change in feeding behavior as the infant develops, commensurately necessitating different bottle feeding flow rates.

One way to accommodate different bottle flow rates is simply to maintain an inventory of bottles and/or bottle components (such as nipples and tops) having different flow rates. A given bottle may be selected or assembled from components to meet a given infant's feeding needs and capacity. Maintaining such an inventory, however, may be inconvenient and expensive, particularly in healthcare or daycare facilities that care for numerous infants at varying developmental stages. Even as to an individual household with one (or perhaps up to a few) infants at a time, multiple bottles or components may be purchased and maintained to accommodate a growing infant, similarly creating added inconvenience and expense.

Attempts have been made at creating a bottle with an adjustable flow rate to accommodate different feeding capacities with one bottle. Conventionally, adjustable bottles employ a valve system to change the flow rate depending upon the feeding circumstances. Although valve bottles may reduce the need for a large inventory of bottles or components, they have other deficiencies. The valve systems typically contain various moving parts, rendering them relatively difficult and expensive to manufacture. In addition, the valve components provide numerous potential failure points, which may require the replacement of parts and other maintenance. This adds to the expense and inconvenience of valve systems for baby feeding bottles.

Applicant's previous U.S. Pat. No. 7,975,861 provided a new baby feeding bottle with enhanced flow characteristics. The nipple design for such baby feeding bottle employed a three-layer nipple design to control flow. Although this three-layer design improved over valve-based baby feeding bottles, the three-layered nipple has proven somewhat cumbersome to manufacture, operate, and clean.

SUMMARY

To improve the user experience with baby feeding bottles, there is a need in the art for an improved, adjustable flow rate feeding assembly for a baby feeding bottle that provides for an adjustable flow rate without a complex valve or other complex nipple configuration system. An exemplary feeding assembly for a baby feeding bottle of the present disclosure includes a dual layered nipple configuration in which the two nipple layers are rotatable relative to each other to adjust the flow rate. An exemplary baby feeding bottle of the present disclosure includes a bottle base having a fluid container portion, and the described feeding assembly from which an infant feeds.

The feeding assembly includes a first or bottom control nipple that receives a feeding fluid directly from a baby feeding bottle or like container, and acts as a control nipple for adjusting the fluid flow rate. The first or control nipple may include multiple selectable setting outlets, each of which provides a different flow rate setting. The feeding assembly is adjustable so that a setting outlet of the control nipple corresponding to a single flow rate setting at a time is provided. Multiple setting outlets permit adjustment of the flow rate to corresponding one of the multiple flow rate settings. In addition, the flow rate setting may be changed in-use or prior to use to attain the varying flow rates, each corresponding to a flow rate setting of the control nipple. In this manner, the feeding assembly may accommodate varying feeding capacities of numerous infants. A second or top outlet nipple may be positioned over the first or control nipple from which an infant may feed.

Accordingly, an aspect of the invention is a feeding assembly for a baby feeding bottle. In an exemplary embodiment, the feeding assembly includes a control nipple for receiving a fluid from a container, and an outlet nipple positioned to receive the fluid from the control nipple and having a feeding outlet through which the fluid flows from the feeding assembly. The control nipple and outlet nipple are moveable relative to each other from a first position to a second position, such that in the first position the fluid is transferred through a tip of the control nipple to the outlet nipple at a first flow rate, and in the second position the fluid is transferred through the tip of the control nipple to the outlet nipple at a second flow rate different from the first flow rate.

In an exemplary embodiment of the feeding assembly, the tip of the control nipple comprises a plurality of selectable setting outlets, at least one of the setting outlets corresponding to the first flow rate and at least one other of the setting outlets corresponding to the second flow rate.

In an exemplary embodiment of the feeding assembly, in the first position fluid flows through the one of the setting outlets at the first flow rate, and in the second position fluid flows through the one other of the setting outlets at the second flow rate.

In an exemplary embodiment of the feeding assembly, the tip of the control nipple includes three setting outlets corresponding respectively to a relative low flow rate, an intermediate flow rate, and a high flow rate.

In an exemplary embodiment of the feeding assembly, the tip of the control nipple includes a closed portion corresponding to a setting in which fluid flow is blocked.

In an exemplary embodiment of the feeding assembly, at least one of the selectable setting outlets is configured to accommodate a fluid thickener.

In an exemplary embodiment of the feeding assembly, the tip of the control nipple includes an upper flat face in which the plurality of selectable setting outlets are formed, and the setting outlets are spaced apart about a perimeter of the upper flat face and positioned off center relative to a center axis perpendicular to the upper flat face.

In an exemplary embodiment of the feeding assembly, the feeding outlet of the outlet nipple is positioned off center relative to the center axis of the feeding assembly.

In an exemplary embodiment of the feeding assembly, in the first position the feeding outlet is aligned with the setting outlet corresponding to the first flow rate, and the one other of the setting outlets corresponding to the second flow rate is selected by rotating the control nipple and the outlet nipple relative to each other from the first position to the second position to align the feeding outlet with the one other of the setting outlets.

In an exemplary embodiment of the feeding assembly, the feeding assembly further includes a nipple base that is rigidly secured to the control nipple, and an adjusting ring that is rigidly secured to the outlet nipple, wherein the control nipple and the outlet nipple are moved relative to each other from the first position to the second position by rotating the adjusting ring relative to the nipple base.

In an exemplary embodiment of the feeding assembly, at least one of the nipple base and the adjusting ring has a visual indicator that indicates whether the control and outlet nipples are in the first position or the second position.

In an exemplary embodiment of the feeding assembly, the feeding assembly further includes at least one visual indicator that indicates whether the control nipple and outlet nipple are in the first position or the second position.

In an exemplary embodiment of the feeding assembly, the visual indicator includes a least a first visual indicator that corresponds to a position of the feeding outlet of the outlet nipple, and a second visual indicator that indicates flow rate settings, and the second position is a position in which a portion of the second visual indicator corresponding the second flow rate is aligned with the first visual indicator.

In an exemplary embodiment of the feeding assembly, the feeding assembly further includes a tactile indicator to indicate the control nipple is in the second position corresponding to the second flow rate.

In an exemplary embodiment of the feeding assembly, the outlet nipple is configured to approximate a human breast nipple to approximate breast feeding.

In an exemplary embodiment of the feeding assembly, the outlet nipple has a conical frame, a concave mid portion, and a tip.

In an exemplary embodiment of the feeding assembly, the tip includes a vertical side and a convex ridge that ends in a tip face, wherein the tip face includes the feeding outlet from which fluid may flow from the outlet nipple, and the concave mid portion has a curvature opposite to the curvature of the conical frame and convex ridge.

In an exemplary embodiment of the feeding assembly, the length of the outlet nipple is equal to or less than 34.1 millimeters (1 5/16 inches) in length.

In an exemplary embodiment of the feeding assembly, the feeding assembly includes a first portion for receiving a fluid from a container, and a second portion positioned to receive the fluid from the first portion and having a feeding outlet through which the fluid flows from the feeding assembly. The first portion and the second portion are moveable relative to each other from a first position to a second position, such that in the first position the fluid is transferred through the first portion to the second portion at a first flow rate, and in the second position the fluid is transferred through first portion to the second portion at a second flow rate different from the first flow rate.

Another aspect of the invention is a baby feeding bottle that includes a container portion for containing a fluid, and the described the feeding assembly.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

Features that are described and/or illustrated with respect to one embodiment may be used in the same way or in a similar way in one or more other embodiments and/or in combination with or instead of the features of the other embodiments.

DETAILED DESCRIPTION OF EMBODIMENTS

Figure 1:
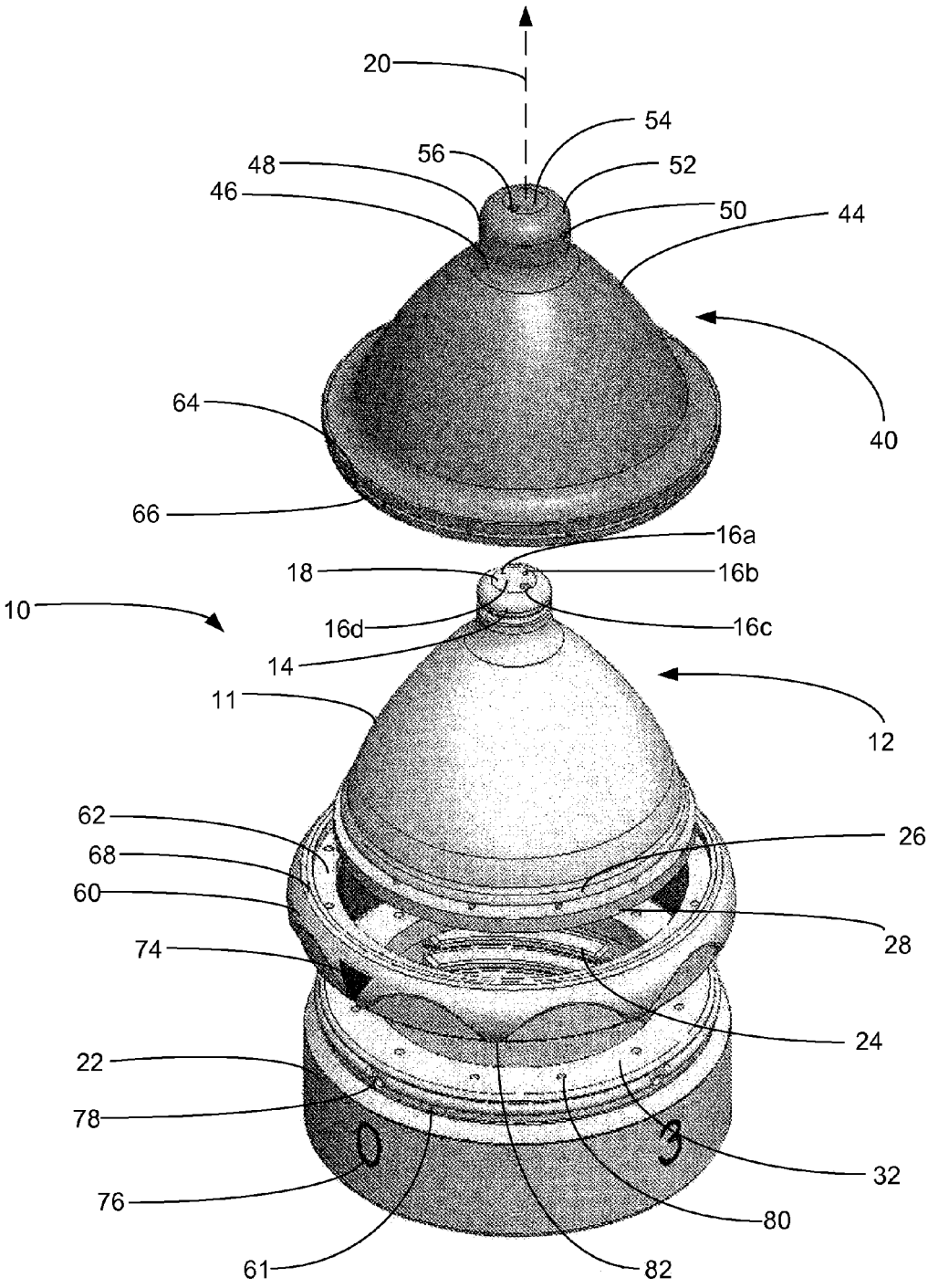
FIG. 1 is a schematic diagram of an isometric view depicting an exploded configuration of a feeding assembly in accordance with embodiments of the present invention.
Figure 2:
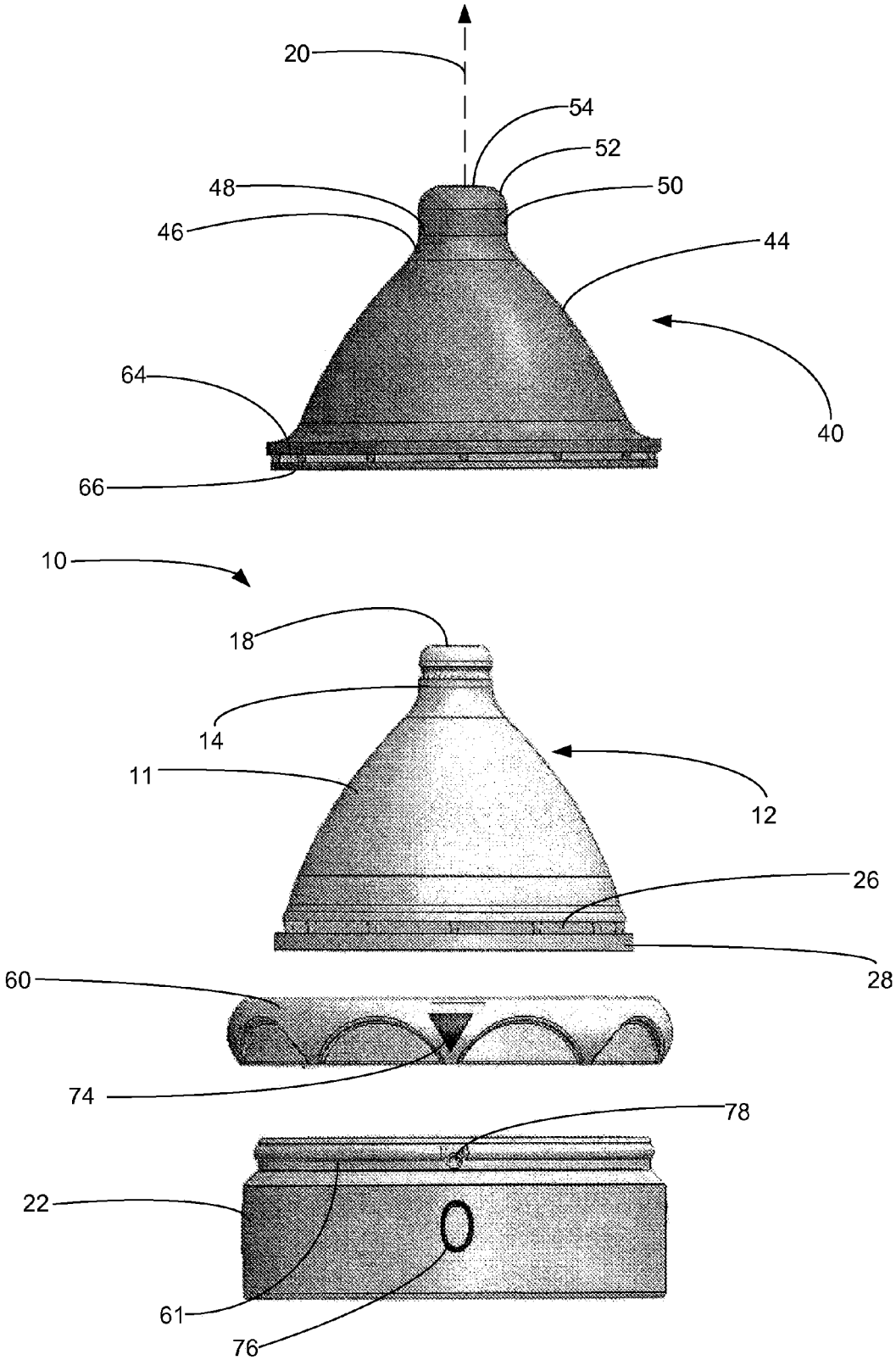
FIG. 2 is a schematic diagram depicting a side view of the feeding assembly of FIG. 1.

FIG. 1 is a schematic diagram depicting an isometric view of an exploded configuration of a feeding assembly 10 in accordance with embodiments of the present invention. FIG. 2 is a schematic diagram depicting a side view of the feeding assembly 10 of FIG. 1.

The feeding assembly 10 includes a first or bottom control nipple 12. The first or control nipple 12 has a generally conical frame 11 and a tip 14 as generally are provided in a baby bottle nipple, with the additional enhancements described below. The control nipple 12 receives fluid directly from a fluid container, such as a baby bottle feeding liner or bottle container (not shown), which flows to the tip 14 of the control nipple 12. The tip 14 of the control nipple includes a plurality of setting outlets to permit the passage of fluid out of the tip of the control nipple at different flow rates, as will be further explained below.

Figure 3:
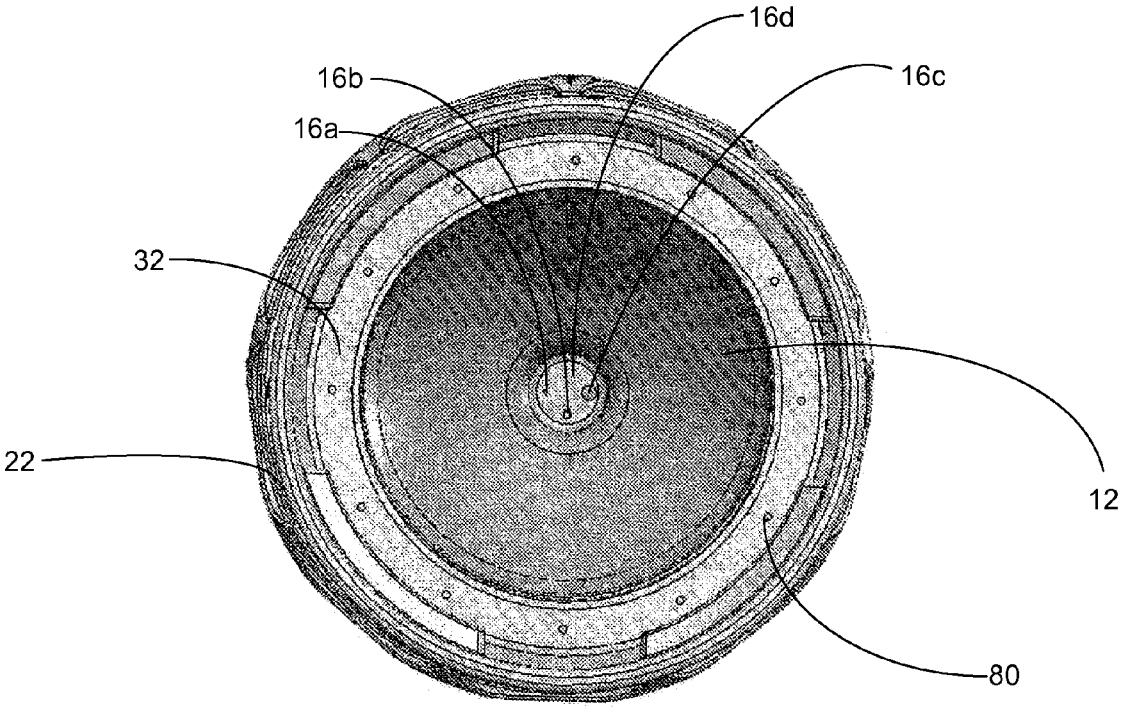
FIG. 3 is a schematic diagram depicting a top view of a first or bottom control nipple attached to a nipple base.

FIG. 3 is a schematic diagram that in part depicts an additional top view of the first or bottom control nipple 12. The first or bottom control nipple 12 controls or regulates the flow rate of fluid that originates in a baby bottle (with or without a liner), or like container. As seen particularly in FIGS. 1 and 3, the tip 14 of the control nipple has a plurality of selectable setting outlets 16*a-c* that each corresponds to a commensurate plurality of flow rate settings. As shown in the referenced figures, the exemplary setting outlets 16*a-c* each constitutes a hole of a different size, thereby permitting different flow rates of a feeding fluid through the control nipple. For example, one setting outlet 16*a* is a relatively smallest hole and represents a lowest relative flow rate, such as may be used for premature babies having a deficient feeding reflex, or by newborns who otherwise may experience difficulty feeding. A second setting outlet 16*b* is of an intermediately sized hole and may correspond to a relatively intermediate flow rate, such as may be used with a healthy newborn with typical feeding capabilities. A third setting outlet 16*c* is the largest hole and may correspond to an advanced or relatively high flow rate, such as may be used with an older or larger infant with a relatively greater feeding capacity.

As another alternative, at least one of the selectable setting outlets is configured to accommodate a fluid thickener. For example, the largest hole setting 16*c* may be utilized for a fluid that contains a thickener, as sometimes are used in N.I.C.U. feedings.

As described above, therefore, the tip of the control nipple includes three setting outlets 16*a-c* corresponding respectively to a relative low flow rate, an intermediate flow rate, and a high flow rate. It will be appreciated that the three-setting configuration of the tip 14 of the control nipple may be varied. Setting outlets of other hole sizes and/or numbers may be employed to provide a variety of corresponding flow rate settings. Furthermore, more than one hole may be employed together to provide a setting outlet for a single flow rate setting. In addition, the tip of the control nipple may include a closed portion 16*d* that corresponds to an additional setting in which flow is substantially prohibited or blocked, effectively to close the bottle to prevent leakage or spills.

As seen in FIGS. 1-3, the tip 14 of the first or bottom control nipple 12 may include an upper flat face 18 in which the plurality of selectable setting outlets 16*a-c* are formed. The setting outlets are spaced apart essentially about the perimeter of the upper flat face 18 of the control nipple. In other words, the setting outlets are positioned off center relative to a center axis 20 (see particularly FIGS. 1 and 2) that passes through the feeding assembly and perpendicularly to the upper flat face 18 of the tip 14 of the control nipple 12.

Referring again to FIGS. 1-3, the feeding assembly 10 further includes a nipple base 22. The nipple base 22 is rigidly secured to the first or bottom control nipple 12. The nipple base 22 has a generally circular bottom that corresponds to a bottom cross section of the control nipple 12. In one embodiment, the nipple base may include fastening extensions or fastening ridges 24 that can cooperate with fastening slots 26 formed in the control nipple 12. Such fastening slots 26 may be formed between a ridge extension 28 and the conical frame 11 that forms the principal body of the control nipple 12. In this manner, when the first or control nipple 12 is secured to the nipple base 22, the ridge extension 28 fits inside the nipple base 22, with the ridge extension 28 being below an upper ring 32 of the nipple base 22. FIG. 3, for example, in particular depicts the first or control nipple 12 in a secured position to the nipple base 22 in top view. As can be seen in FIG. 3, the upper ring 32 of the nipple base 22 is visible. The ridge extension 28 is secured within the nipple base 22 beneath the upper ring 32, thereby rigidly securing the nipple into the base.

The manner of securing the first or control nipple 12 to the nipple base 22 may be varied. For example, in an alternative embodiment the control nipple and nipple base may be molded or otherwise formed as a single unitary piece. In such case, the control nipple and the nipple base may be made of the same material to form such unitary piece. Generally, as stated above the precise manner of securing the control nipple to the nipple base, or of forming a unitary piece including the control nipple and the nipple base, may be varied. Any suitable securing structures, such as various ridge structures, slot structures, threaded structures, snap in/out structures, and the like may be employed as are suitable for securing baby bottle nipples.

The nipple base configuration may be securable to essentially any conventional baby bottle or similar feeding container or liner by any conventional means as are known in the art. For example, the nipple base may include threads that can cooperate with opposite threads on a rim or top portion the baby feed bottle or fluid container. "Pop-on and pop-off" features also may be employed so as to secure the nipple base to a baby feeding bottle or similar fluid container. Other suitable configurations may be employed to secure the nipple base to a baby feeding bottle or fluid container. In this manner, with the first or bottom control nipple being secured to, or unitarily formed with, the nipple base, the control nipple becomes positioned in fluid communication with the bottle or fluid container such that feeding fluid flows from the container into and through the control nipple.

To provide ease of cleaning and maintenance, it is preferable that the nipple base and control nipple be secured together or formed together so as to be a unitary piece. In another alternative embodiment, however, the fastening slots 26 of the control nipple can cooperate with fastening ridges formed in the baby feeding bottle or fluid container itself. In such embodiments, the nipple base may be provided in the form of a fastening ring that may hold the control nipple in fluid communication with the baby feeding bottle or fluid container. In such embodiment, the nipple base 22 would act as a ring that is open at the top and bottom. The top opening may be smaller than the bottom opening, although the precise configuration of the fastening ring may vary. The fastening ring 22 may include a circumferential ridge that cooperates with a circumferential groove of the bottle or fluid container to secure the fastening ring longitudinally to the bottle. For example, the fastening ring may be snapped over an upper portion of the bottle such that ridge rests within a groove of the bottle. This configuration substantially prevents longitudinal separation of the fastening ring from the bottle in response to forces occurring in use, but a user may remove the fastening ring by applying a removing force. It will be appreciated that when the control nipple is first secured to the bottle or feeding container, the nipple base in the form of a fastening ring fits over the nipple such that the tip of the control nipple protrudes through the fastening ring.

Figure 4:
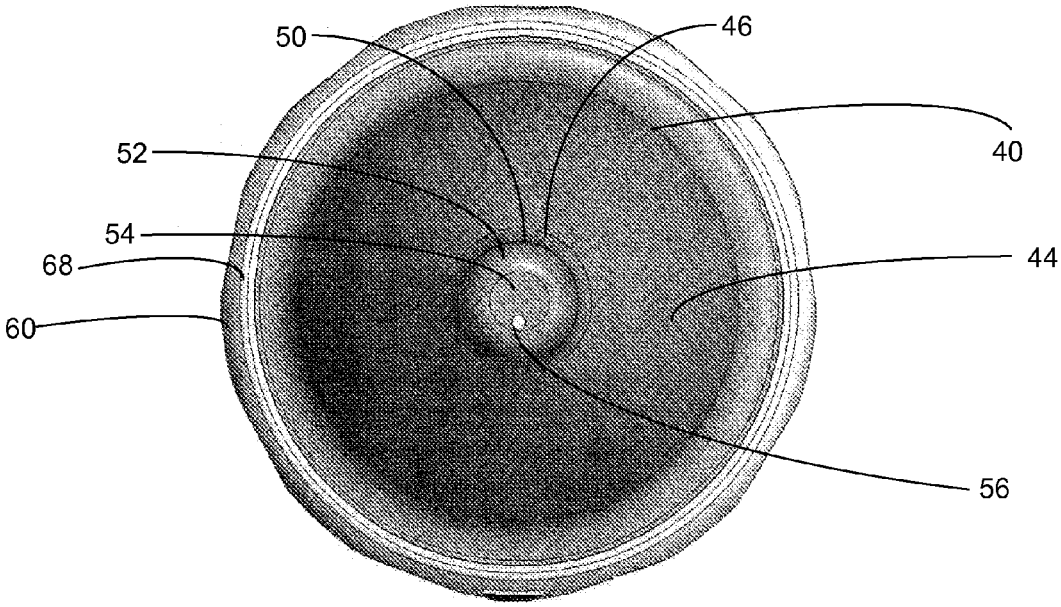
FIG. 4 is a schematic diagram that depicts a top view of a second or outlet nipple attached to an adjusting ring.

The feeding assembly 10 also includes a second or upper nipple 40, which also is referred to as an outlet nipple because it has a feeding outlet 56 from which a baby feeds. FIG. 4 is a schematic diagram that in part further depicts a top view of the outlet nipple 40. The second or outlet nipple 40 is configured and shaped in a manner that approximates a breast nipple to enhance feeding behavior. The second or outlet nipple has a generally conical frame 44, a concave mid portion 46, and a tip 48. The tip 48 further includes a vertical side 50 and a convex ridge 52 that ends in a tip face 54. The tip face 54 has outlet hole or holes 56 through which fluid may flow from the outlet nipple 40. Applicant has found that such configuration of the tip 48 in particular approximates a breast nipple shape so as to enhance feeding. To further approximate a breast nipple, the overall length of the second or outlet nipple is shorter than a conventional bottle nipple. For example, the length of the second or outlet nipple may be about half the length of a conventional bottle nipple, or equal to or less than about 34.1 millimeters (1 5/16 inches) in length. The concave mid portion 46 has a curvature opposite to the curvature of the conical frame 44 and convex ridge 52. This configuration provides for a more natural feel and a better for latching on of a feeding infant.

As stated above, the tip 48 of the second or outlet nipple includes a tip face 54 that has a feeding outlet 56 constituting a hole or holes to transmit fluid from which an infant may feed. In one embodiment, the feeding outlet may have a configuration of multiple holes intended to mimic a human breast nipple. The feeding outlet 56 would be associated with a maximum flow capacity for feeding. As used herein, the term "maximum flow capacity" is a relative term, meaning that the flow capacity through the feeding outlet is at least as large or larger than the flow rate through the any of the setting outlets 16*a-c* of the control nipple. In this manner, regardless of the flow rate setting, the feeding outlet 56 should not provide any restriction on feeding, with the flow rate thus being determined by the control nipple. Due to the combination of shape and hole configuration, in use the outlet nipple of the present disclosure may approximate breast feeding more than conventional bottle nipples to reduce feeding disruptions or difficulties that may otherwise occur due to switching between bottle feeding and breast feeding.

In exemplary embodiments, the feeding outlet 56 is positioned off center relative to the center axis 20 (see FIGS. 1 and 2) that passes through the feeding assembly perpendicularly to the upper tip face of the outlet nipple. As further described below, because the feeding outlet 56 is off center, and the setting outlets 16*a-d* (which include the closed "off setting") of the control nipple likewise are positioned off center, the feeding outlet of the outlet nipple may be aligned with one of the plurality of setting outlets of the control nipple. Because the setting outlets provide for different flow rates, the flow rate through the outlet nipple is thus regulated and may be adjusted by the flow rate settings of the setting outlets of the control nipple.

As seen in FIGS. 1, 2, and 4, the conical frame 44 of the second or outlet nipple 40 may be attached to or formed with an adjusting ring 60. The adjusting ring may be rigidly secured to the outlet nipple. The adjusting ring 60 has a generally circular configuration that corresponds to a bottom cross section of the outlet nipple 40. The outlet nipple may be secured to the adjusting ring in comparable manner as the control nipple is secured to the nipple base. In one embodiment, the adjusting ring 60 may include fastening extensions or fastening ridges 62 that can cooperate with fastening slots 64 formed in the outlet nipple 40. Such fastening slots 64 may be formed between a ridge extension 66 and the conical frame 44 that forms the principal body of the outlet nipple 40. In this manner, when the second or outlet nipple 40 is secured to the adjusting ring 60, the ridge extension 66 fits inside adjusting ring 40, with the ridge extension 66 being below an upper surface 68 of the adjusting ring 40. FIG. 4, for example, in particular depicts the second or outlet nipple 40 in a secured position to adjusting ring 60 in top view. As can be seen in FIG. 4, an upper surface 68 of the adjusting ring 40 is visible. The ridge extension 66 is secured within the adjusting ring 40 beneath the upper surface 68, thereby securing the outlet nipple into the adjusting ring.

The manner of securing the second or outlet nipple 40 to the adjusting ring 60 may be varied as well. For example, in an alternative embodiment the outlet nipple and adjusting ring may be molded or otherwise formed as a single unitary piece. In such case, the outlet nipple and the adjusting ring may be made of the same material to form such unitary piece. Generally, as stated above the precise manner of securing the outlet nipple to the adjusting ring, or of forming a unitary piece including the outlet nipple and the adjusting ring, may be varied. Any suitable securing structures, such as various ridge structures, slot structures, threaded structures, snap in/out structures, and the like may be employed as are suitable for securing baby bottle nipples.

Figure 5:
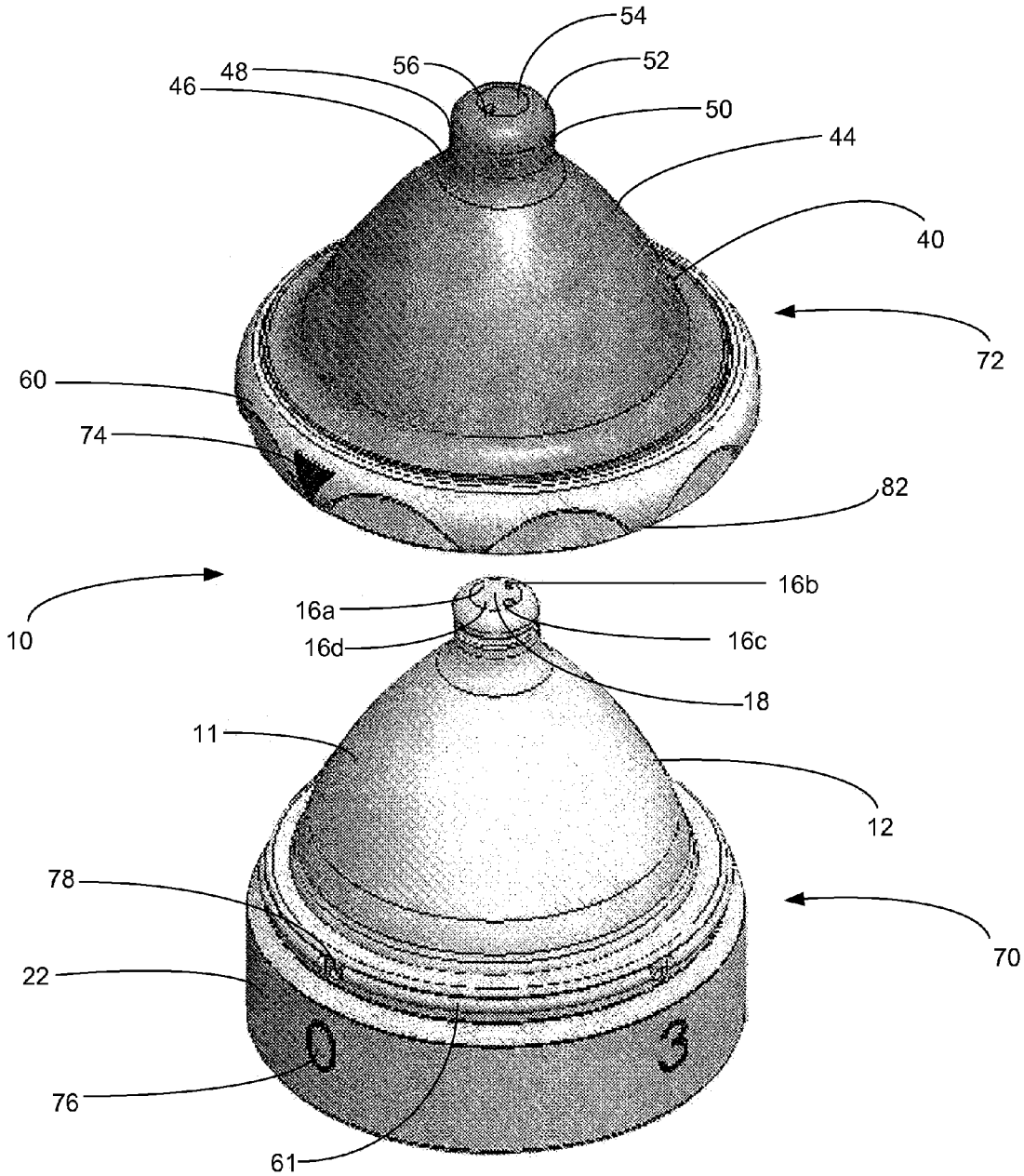
FIG. 5 is a schematic diagram depicting an isometric view of an intermediate assembly of the feeding assembly, including an upper feeding assembly portion and a lower feeding assembly portion.
Figure 6:
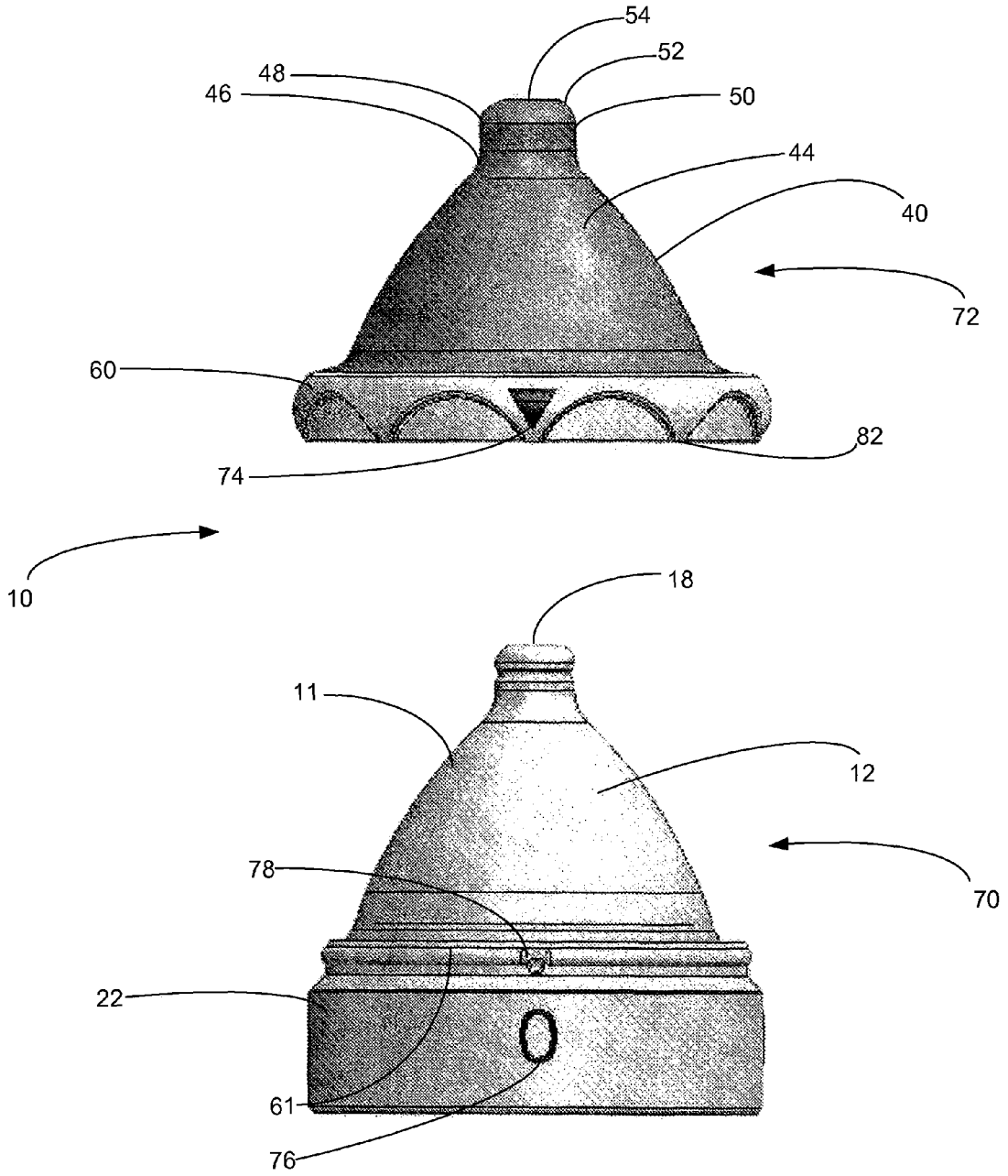
FIG. 6 is a schematic diagram depicting a side view of the feeding assembly portions depicted in FIG. 5.

FIG. 5 depicts an isometric view of an intermediate assembly of the feeding assembly 10, including a first or lower feeding assembly portion 70 and a second or upper feeding assembly portion 72. FIG. 6 depicts a side view of the feeding assembly portions depicted in FIG. 5.

As seen in FIGS. 5 and 6, the upper feeding assembly portion 72 includes the second or outlet feeding nipple 40 attached to the adjusting ring 60, as described above. The lower feeding assembly portion 70 includes the first or control nipple 12 attached to the nipple base 22, as described above.

The lower and upper feeding assemblies 70 and 72 may be joined to each other by a mechanical fastening system 61. In exemplary embodiments, the adjusting ring 60 holding the outlet nipple may have a groove or grooves that cooperate with opposite protrusions in the nipple base 22 for holding the control nipple. The reverse may be true in that the adjusting ring may have a protrusion or protrusions that cooperate with opposite grooves in the nipple base. In this manner, the adjusting ring may be screwed or snapped onto the nipple base such that the outlet nipple is secured over the control nipple. The cooperating grooves and protrusions of the adjusting ring and nipple base form a cooperating slot structure that permits the adjusting ring (and therefore the outlet nipple) to be turned relative to the nipple base (and therefore the control nipple), and vice versa.

Accordingly, the feeding assembly includes the first or lower portion 70 for receiving a fluid from a container, and the second or upper portion 72 positioned to receive the fluid from the first portion and having a feeding outlet through which the fluid flows from the feeding assembly. As further described below, the first portion and the second portion are moveable relative to each other from a first position to a second position, such that in the first position the fluid is transferred through the first portion to the second portion at a first flow rate, and in the second position the fluid is transferred through first portion to the second portion at a second flow rate different from the first flow rate.

As stated above, the feeding outlet 56 of the outlet nipple 40 is positioned off center relative to a center axis of the feeding assembly. Similarly, each of the setting outlets 16*a-c* of the control nipple 12 is positioned off center relative to the center axis of the feeding assembly. With such configuration, as the adjusting ring 60 (and therefore the outlet nipple 40) is turned relative to the nipple base 22 (and therefore the control nipple 12) via the groove/slot fastening system 61, the feeding outlet will be aligned sequentially and in turn with each of the setting outlets. In this manner, in a first position the feeding outlet is aligned with the setting outlet corresponding to a first flow rate, and one other of the setting outlets corresponding to the second flow rate is selected by rotating the control nipple and the outlet nipple relative to each other from the first position to the second position to align the feeding outlet with the one other of the setting outlets. The control nipple and outlet nipple are rotated relative to each by rotating the upper feeding assembly portion 70 and the lower feeding assembly portion 72 relative to each other.

For example, in one position the feeding outlet is aligned with the smallest setting outlet 16*a*, permitting the least flow as would be utilized for a premature infant with a relatively smaller feeding capacity. In another position, the feeding outlet is aligned with the intermediate setting outlet 16*b*, permitting an intermediate flow that would be used for a newborn infant or the like with an intermediate feeding capacity. In another position, the feeding outlet is aligned with the largest setting outlet 16*c*, permitting the greatest flow as would be utilized for a relatively older or larger infant with a relatively greater feeding capacity. Other intermediate settings optionally may be employed by providing additional intermediate setting outlets between the largest and smallest. In yet another position, the feeding outlet may be aligned with the closed portion 16*d* of the control nipple that corresponds to an additional setting in which flow is substantially prohibited, effectively to close the bottle to prevent leakage or spills.

Figure 7:
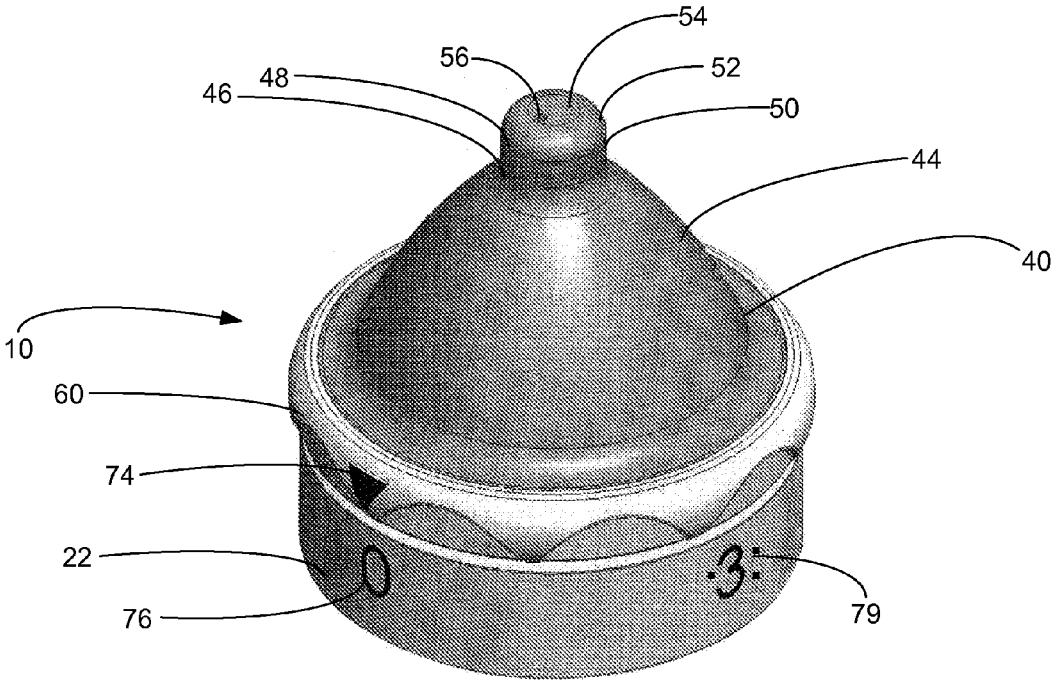
FIG. 7 is a schematic diagram depicting an isometric view of the entire feeding assembly 10, in which the upper feeding assembly portion 70 and the lower feeding assembly portion 72 are joined together.
Figure 8:
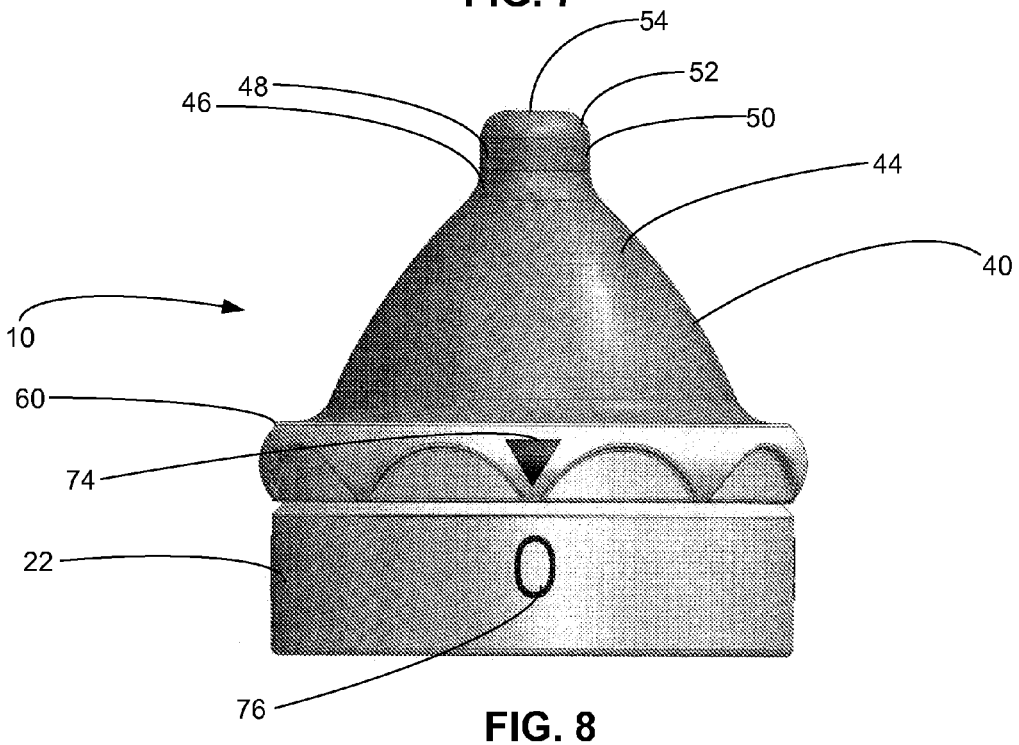
FIG. 8 is a schematic diagram depicting a side view of the joined feeding assembly portions depicted in FIG. 7.

FIG. 7 is a schematic diagram depicting an isometric view of the entire feeding assembly 10, in which the upper feeding assembly portion 70 and the lower feeding assembly portion 72 are joined together. FIG. 8 is a schematic diagram depicting a side view of the joined feeding assembly portions depicted in FIG. 7.

In exemplary embodiments, the feeding assembly 10 may include at least one visual indicator to indicate a current flow rate setting. For example, as identified for convenience in FIGS. 1-2 and 7-8 (although the pertinent features appear in other figures as well) the adjusting ring 60 is provided with a first visual indicator 74, such as an arrow indicator, that corresponds to a position of the feeding outlet of the outlet nipple. In addition, the nipple base 22 is provided with a second visual indicator 76, such as numerical indicators identified by the numbers 0-4, which indicate the flow rate settings, including the closed portion of the control nipple (0), and the setting outlets from the 16*a-c* from the smallest to largest (1-3, respectively). To select a flow rate setting, the first visual indicator is aligned with a portion of the second visual indicator corresponding to the desired flow rate setting.

In particular, to adjust the flow rate of the feeding assembly 10, the upper feeding assembly portion 70, including the outlet nipple and adjusting ring, may be turned relative to the lower feeding assembly 72, including the control nipple and nipple base, to align the first arrow indicator 74 of the adjusting ring with a numerical indicator of the second indicator 76 on the nipple base corresponding to the desired setting outlet. For example, as depicted in best in FIG. 7, the number indicator for the "0" setting is aligned with the indicator 74 (arrow indicator), which are both aligned with the feeding outlet 56 of the outlet nipple 40. This would indicate to the user that the feeding assembly is in the closed position that would corresponding to the closed setting 16*d* of the control nipple. By rotating or turning the upper feeding assembly portion 70 relative to the lower feeding assembly 72, the user can align any of the other number indicators 1-3 (corresponding to the control nipple settings 16*a-c*) with the arrow indicator, and thus aligned with the outlet nipple, to achieve the desired flow rate setting. It will be appreciated that the described visual indicators represent examples, and other visual indications of a flow rate setting may be employed. For example, the arrow indicator and/or number indicators may be replaced by lines, notches, indentations, shadows, symbols, or any other suitable visual indicator.

Tactile indicators also may be employed to indicate to indicate a selection of a particular flow rate setting. More specifically, the tactile indicator may indicate the control nipple is in a position corresponding to the flow rate through the control nipple. In conjunction with the visual indicators, the tactile indictor may indicate an alignment of the outlet nipple as indicated by the first visual indicator, and a control nipple setting for a particular flow rate setting as indicated by the corresponding portion of the second visual indicator. Referring to FIGS. 1-2 and 5-6 as representative, the adjusting ring 60 may include a tactile indicator 78 in the form of a notch that corresponds to the position of the feeding outlet of the outlet nipple. In addition, the nipple base 22 may include a plurality of protrusions, with each protrusion corresponding to the location of each of the setting outlets and the closed portion of the control nipple. When the feeding outlet is aligned with a setting outlet or closed portion, the notch 78 of the adjusting ring may "click" into place with one of the protrusions of the nipple base to provide a tactile indication to the user that the feeding outlet is positioned in accordance with one of the flow rate settings.

The fastening assembly 10 may have additional tactile indicators to aid movement across intermediate positions between the actual settings described above. Referring again to FIGS. 1 and 2, to aid in adjusting the position of nipple base 22 relative to adjusting ring 60, the nipple base may include plurality of positioning holes 80 position along the upper ring 32 of the nipple base 22. At least one such positioning hole 80 would be located corresponding to the notch 78 when the feeding assembly is configured for a particular one of the flow rate settings (including the closed setting). The positioning holes 80 otherwise would be positioned corresponding to a plurality of cooperating extensions 82 located in the adjusting ring 60. As the user adjusts the feeding assembly from one flow rate setting to the next, a series of intermediate tactile "clicks" may be felt by the user as the position holes in turn sequentially cooperate with the extensions 82 until the feeding assembly achieves the next setting configuration. Preferably, the number of positioning holes 80 equals the number of cooperating extensions 82, and the distance between adjacent positioning holes 80 would be equal to the distance between adjacent cooperating extensions 82. Such intermediate tactile sensations aid the securing and adjusting the feeding assembly to any desired flow rate setting. The clicks of the holes 80 and extensions 82 may be minor as compared to the click of the notch 78 so as to distinguish between a position of a flow rate setting versus intermediate positions.

Another type of tactile indicator would be to add a dot or nub protrusion indicator 79 adjacent the second visual indicator for the flow rate settings. The number of nub protrusions may correspond to the flow rate setting. For example, one nub protrusion may be provided adjacent the visual indicator "1", two nub protrusions may be provided adjacent the visual indicator "2", and so on. The closed setting "0" would not have any corresponding nub protrusions. This type of tactile indicator is illustrated in FIG. 7 as an example showing three nubs 79 corresponding to the numerical indicator "3", and no nubs corresponding to the "0" setting.

Figure 9:
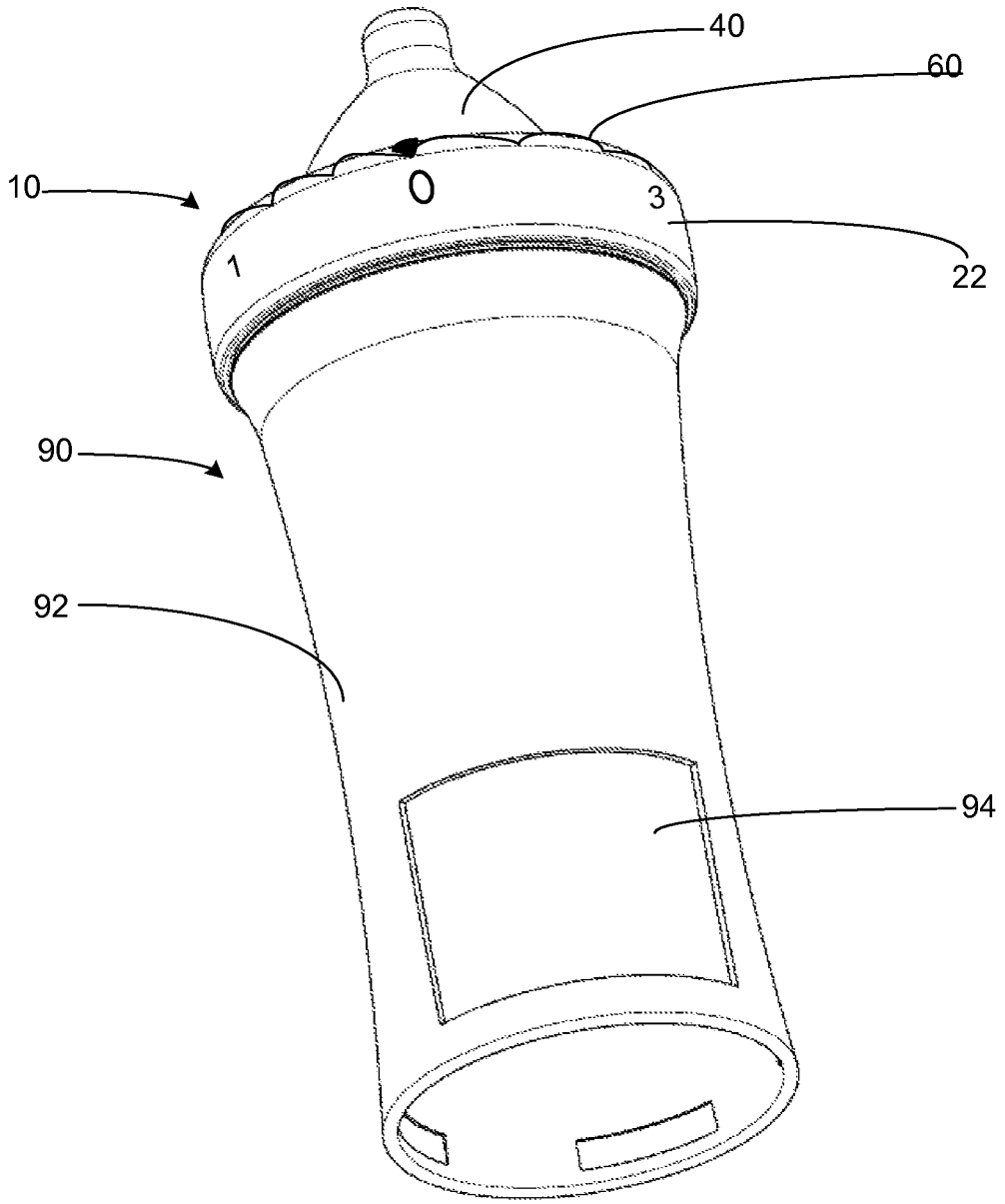
FIG. 9 is a schematic isometric view of an exemplary baby feeding bottle in accordance with embodiments of the present invention.

FIG. 9 is a schematic isometric view of an exemplary baby feeding bottle 90. The feeding bottle 90 includes a container portion 92 that forms a bottle base and the feeding assembly 10 as described above. As shown, the container portion 92 may be a hollow cylindrical casing for including or receiving a container for containing a feeding fluid, such as a conventional feeding liner (not shown in this figure). The feeding fluid may be breast milk, formula, juice, water, etc. In an alternative embodiment, the container portion 92 may be a closed cylinder and itself constitute the container for the feeding fluid. The base may contain a label area 94 for displaying indentifying information. For example, a user may write a name of an infant for whom the bottle is intended with an erasable writing instrument. Other forms of the label area may be employed. For example, the label area may comprise a transparent window for receiving an interchangeable label containing the identifying information. The label area is particularly useful in healthcare and other care centers in which the bottle may be sterilized and reused for numerous infants. As referenced above, the feeding assembly 10 may be secured to the bottle base by threaded or like fastening structures that permit the feeding assembly to be screwed onto, or snapped on and off in a "pop on/off) fashion, the bottle base 92.

In this FIG. 9, with the feeding assembly 10 secured to the bottle base 92, the outlet nipple 40, nipple base 22, and adjusting ring 60 are principally visible. It will be appreciated that fluid may flow into the first or bottom control nipple 12 (not seen in FIG. 9), through one of the setting outlets 16*a-c*, and into the outlet nipple 40. During feeding the fluid would then flow from the feeding outlet 56 of the outlet nipple 40.

The bottle 90 and its constituent components, container portion 92 and feeding assembly 10 (and sub-components thereof), may be made of various suitable materials as are known in the art. For example, appropriate materials may include polyethersulfone (PES), polyactide, polyamide (PA), polypropylene (PP), and/or hospital grade silicone. Of note, the bottle and feeding assembly of the present disclosure may be manufactured without the use of Bisphenol A (BPA), which in some scientific studies has been linked to certain hazardous effects including "estrogenicity", or the presence of estrogen-like compounds in the breast milk or other feeding liquid resulting from heating a bottle made with BPA.

An exemplary use of the disclosed feeding assembly to provide enhanced fluid flow characteristics will now be described. In particular, the fluid flow rate may be adjusted as needed depending upon the feeding circumstances.

Generally, the feeding assembly for the baby feeding includes the control nipple for receiving a fluid from a container, and the outlet nipple positioned to receive the fluid from the control nipple and having a feeding outlet through which the fluid flows from the feeding assembly. The control nipple and outlet nipple are moveable relative to each other from a first position to a second position, such that in the first position the fluid is transferred through a tip of the control nipple to the outlet nipple at a first flow rate, and in the second position the fluid is transferred through the tip of the control nipple to the outlet nipple at a second flow rate different from the first flow rate. In the first position the feeding outlet is aligned with one of the setting outlets corresponding to the first flow rate, and another one other of the setting outlets corresponding to the second flow rate is selected by rotating the control nipple and the outlet nipple relative to each other from the first position to the second position to align the feeding outlet with the one other of the setting outlets.

For example, suppose a caretaker wishes to feed an infant who is having difficulty or has a deficient feeding capacity, meaning that a low flow rate is warranted. By rotating the adjusting ring 60 relative to the nipple base 22, thereby rotating the outlet nipple 40 relative to the control nipple 12 (or vices versa), the feeding outlet 56 of the outlet nipple 40 may be aligned with one of the setting outlets of the control nipple. For example, if a relatively low flow rate is desired, a user may turn the adjusting ring 60 to align the feeding outlet 56 of the outlet nipple 40 with the smallest setting outlet 16*a* of the control nipple 12. If an infant has an intermediate feeding capacity, a user may align the feeding outlet 56 of the outlet nipple 40 with the medium sized setting outlet 16*b* of the control nipple for a relatively intermediate flow rate. Similarly, if an infant has an advanced feeding capacity, a user may align the feeding outlet 56 of the outlet nipple 40 with the largest setting outlet 16*c* of the control nipple for a relatively advanced or high flow rate. A user may also align the feeding outlet 56 of the outlet nipple 40 with the closed portion 16*d* of the control nipple 12, thereby substantially precluding fluid flow. In this manner, the feeding assembly essentially may be "turned off" to reduce the propensity for leaks and spills when an infant is not specifically feeding.

When an infant is feeding, fluid first flows largely under the force of gravity due to the tilt of the baby bottle 90 (which as referenced above either may be closed container or include a fluid liner) directly into the control nipple 12. Depending upon which setting outlet 16*a-c* is aligned with the feeding outlet 56 of the outlet nipple 40, flow through the control nipple 12 (and into the outlet nipple) is adjusted to suit particular feeding circumstances as described above. As an infant feeds through the outlet nipple 56, the sucking force draws in fluid at substantially a flow rate set by the aligned setting outlet of the control nipple.

A caretaker may also adjust the fluid flow rate during use. For example, suppose a caretaker is to feed an infant known for having a deficient feeding capacity. The caretaker initially may set the flow rate to the lowest setting. As feeding proceeds, the infant may relax or settle into feeding, resulting in a greater feeding capacity. A caretaker may then rotate the nipple base 22 (and the attached bottle and/or fluid liner) relative to the adjusting ring 60 such that the flow rate is set to the next highest setting. In other words, the feeding outlet 56 of the outlet nipple 40 may be realigned "in use" during feeding by rotating the nipple base to a setting outlet of the control nipple corresponding to the next increased flow rate. This ability to alter the flow rate during use provides a convenient way to "train" an infant to improve feeding behavior, which would be more difficult if the bottle had be to removed from the infant to reset the flow rate, thereby disrupting feeding.

In addition to in-use adjustment, the flow rate may be adjusted before use so that the bottle may be reused with numerous infants having varying feeding capacities. Similarly, a parent or home caretaker may adjust the flow rate for a single infant as the infant's feeding capacity increases with development.

It will be appreciated that the feeding assembly of the current disclosure has numerous advantages over known feeding assemblies. The feeding assembly of the current disclosure provides for an adjustable flow rate to accommodate the feeding capacities of numerous infants, or the changing feeding capacity of a single infant. In addition, the flow rate may be adjusted in use to provide for training an infant who may have a deficient feeding capacity, or may be at a developmental stage when capacity is increasing. The feeding assembly may be readily assembled and disassembled for convenient cleaning, sanitation, and reuse. In addition, adjustability is accomplished without the use of complex valves or other more complex nipple configurations, thereby reducing manufacturing complexities and cost. By avoiding the use of valve systems or other more complex nipple configurations, maintenance complexities and the potential for the failure of intricate moving parts may also be reduced. The outlet nipple also approximates breastfeeding more than conventional nipples, thereby reducing disruptions caused by switching between bottle feeding and breastfeeding.

Although the invention has been shown and described with respect to certain preferred embodiments, it is understood that equivalents and modifications will occur to others skilled in the art upon the reading and understanding of the specification. The present invention includes all such equivalents and modifications, and is limited only by the scope of the following claims.

What is claimed is:

1. A feeding assembly for a baby feeding bottle comprising:

a control nipple for receiving a fluid from a container; and an outlet nipple positioned to receive the fluid from the control nipple and having a feeding outlet through which the fluid flows from the feeding assembly;

wherein the control nipple and outlet nipple are moveable relative to each other from a first position to a second position, such that in the first position the fluid is transferred through a tip of the control nipple to the outlet nipple at a first flow rate, and in the second position the fluid is transferred through the tip of the control nipple to the outlet nipple at a second flow rate different from the first flow rate.

2. The feeding assembly of claim 1, wherein the tip of the control nipple comprises a plurality of selectable setting outlets, at least one of the setting outlets corresponding to the first flow rate and at least one other of the setting outlets corresponding to the second flow rate.

3. The feeding assembly of claim 2, wherein in the first position fluid flows through the one of the setting outlets at the first flow rate, and in the second position fluid flows through the one other of the setting outlets at the second flow rate.

4. The feeding assembly of claim 2, wherein the tip of the control nipple includes three setting outlets corresponding respectively to a relative low flow rate, an intermediate flow rate, and a high flow rate.

5. The feeding assembly of claim 4, wherein the tip of the control nipple includes a closed portion corresponding to a setting in which fluid flow is blocked.

6. The feeding assembly of claim 2, wherein at least one of the selectable setting outlets is configured to accommodate a fluid thickener.

7. The feeding assembly of claim 2, wherein the tip of the control nipple includes an upper flat face in which the plurality of selectable setting outlets are formed, and the setting outlets are spaced apart about a perimeter of the upper flat face and positioned off center relative to a center axis perpendicular to the upper flat face.

8. The feeding assembly of claim 7, wherein the feeding outlet of the outlet nipple is positioned off center relative to the center axis of the feeding assembly.

9. The feeding assembly of claim 8, wherein in the first position the feeding outlet is aligned with the setting outlet corresponding to the first flow rate, and the one other of the setting outlets corresponding to the second flow rate is selected by rotating the control nipple and the outlet nipple relative to each other from the first position to the second position to align the feeding outlet with the one other of the setting outlets.

10. The feeding assembly of claim 1, further comprising a nipple base that is rigidly secured to the control nipple, and an adjusting ring that is rigidly secured to the outlet nipple, wherein the control nipple and the outlet nipple are moved relative to each other from the first position to the second position by rotating the adjusting ring relative to the nipple base.

11. The feeding assembly of claim 10, wherein at least one of the nipple base and the adjusting ring has a visual indicator that indicates whether the control and outlet nipples are in the first position or the second position.

12. The feeding assembly of claim 1, further comprising at least one visual indicator that indicates whether the control nipple and outlet nipple are in the first position or the second position.

13. The feeding assembly of claim 12, wherein the visual indicator includes a least a first visual indicator that corresponds to a position of the feeding outlet of the outlet nipple, and a second visual indicator that indicates flow rate settings, and the second position is a position in which a portion of the second visual indicator corresponding the second flow rate is aligned with the first visual indicator.

14. The feeding assembly of claim 1, further comprising a tactile indicator to indicate the control nipple is in the second position corresponding to the second flow rate.

15. The feeding assembly of claim 1 any of claims 1, wherein the outlet nipple is configured to approximate a human breast nipple to approximate breast feeding.

16. The feeding assembly of claim 15, wherein the outlet nipple has a conical frame, a concave mid portion, and a tip.

17. The feeding assembly of claim 16, wherein the tip includes a vertical side and a convex ridge that ends in a tip face, wherein the tip face includes the feeding outlet from which fluid may flow from the outlet nipple, and the concave mid portion has a curvature opposite to the curvature of the conical frame and convex ridge.

18. The feeding assembly of claim 1, wherein the length of the outlet nipple is equal to or less than 34.1 millimeters (1 5/16 inches) in length.

19. A feeding assembly for a baby feeding bottle comprising:

a first portion for receiving a fluid from a container; and a second portion positioned to receive the fluid from the first portion and having a feeding outlet through which the fluid flows from the feeding assembly;

wherein the first portion and the second portion are moveable relative to each other from a first position to a second position, such that in the first position the fluid is transferred through the first portion to the second portion at a first flow rate, and in the second position the fluid is transferred through first portion to the second portion at a second flow rate different from the first flow rate.

20. A baby feeding bottle comprising:

a container portion for containing a fluid; and the feeding assembly according to claim 1.

* * * * *